US011394149B2

(12) United States Patent
Zhang

(10) Patent No.: US 11,394,149 B2
(45) Date of Patent: Jul. 19, 2022

(54) ELECTRICAL CONNECTOR AND ELECTRICAL CONNECTOR ASSEMBLY

(71) Applicant: Molex, LLC, Lisle, IL (US)

(72) Inventor: Teng-Fei Zhang, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/177,252

(22) Filed: Feb. 17, 2021

(65) Prior Publication Data

US 2021/0257766 A1 Aug. 19, 2021

(30) Foreign Application Priority Data

Feb. 19, 2020 (CN) ..... 202010101831.3

(51) Int. Cl.
*H01R 13/24* (2006.01)
*H01R 13/08* (2006.01)
(Continued)

(52) U.S. Cl.
CPC ..... *H01R 13/2407* (2013.01); *H01R 13/08* (2013.01); *H01R 13/2471* (2013.01); *H01R 13/41* (2013.01); *H01R 12/58* (2013.01)

(58) Field of Classification Search
CPC .... H01R 13/08; H01R 12/58; H01R 13/2471; H01R 13/2407; H01R 13/141; H01R 13/2421
See application file for complete search history.

(56) References Cited

U.S. PATENT DOCUMENTS 8,062,078 B2 * 11/2011 Asai ..... H01R 13/2421 439/823
8,066,537 B1 * 11/2011 Lin ..... H01R 13/2421 439/824

(Continued)

FOREIGN PATENT DOCUMENTS

CN 201887154 U 6/2011

*Primary Examiner* — Briggitte R. Hammond

(57) ABSTRACT

The present disclosure provides an electrical connector and an electrical connector assembly, the electrical connector includes a conductive seat, a movable contact pin and a spring member. The conductive seat includes a first receiving section, a second receiving section, at least one connection arm connected between the first receiving section and the second receiving section, and two elastic contact arms bending from one of the first receiving section and the second receiving section toward the other of the first receiving section and the second receiving section and extending; a through hole is provided to a front end of the first receiving section. The movable contact pin includes a mating portion, a tail portion and a connecting portion connected between the mating portion and the tail portion; the movable contact pin is mounted in the conductive seat in a manner that the movable contact pin can move back and forth in the conductive seat, the mating portion protrudes forwardly from the through hole; the two elastic contact arms elastically press against the connecting portion whether in a mating state or a non-mating state. The spring member is received in the conductive seat and used to elastically drive the movable contact pin to move forwardly in the conductive seat. The present disclosure may realize stable reliable electrical connection.

10 Claims, 11 Drawing Sheets

(51) Int. Cl.
*H01R 13/41* (2006.01)
*H01R 12/58* (2011.01)

(56) References Cited

U.S. PATENT DOCUMENTS

| | | | | |
|---|---|---|---|---|
| 8,491,338 | B1 * | 7/2013 | Lin | H01R 13/2421 439/627 |
| 9,350,104 | B1 * | 5/2016 | Chen | H01R 12/716 |
| 9,748,680 | B1 * | 8/2017 | Huang | H01R 12/714 |
| 10,468,804 | B2 * | 11/2019 | Kawamura | H01R 13/2421 |
| 10,777,928 | B1 * | 9/2020 | Yen | H01R 13/11 |
| 2020/0203873 | A1 * | 6/2020 | Wang | H01R 13/2421 |

* cited by examiner

ELECTRICAL CONNECTOR AND ELECTRICAL CONNECTOR ASSEMBLY

RELATED APPLICATION

This application claims the benefit of Chinese Application No. 202010101831.3, filed on Feb. 19, 2020, which is incorporated herein by reference in its entirety.

TECHNICAL FIELD

The present disclosure relates to the field of electrical connectors, particularly relates to an electrical connector which can realize stable reliable electrical connection and an electrical connector assembly which has the electrical connector.

BACKGROUND

Chinese utility model patent application issuance No. CN201887154U discloses a pin-type connector, which includes a shell, a pin and an elastic body, the shell is formed by integrally stamping a metal plate and has a receiving shell, one end of the pin is received in the receiving shell of the shell, other end of the pin extends out of the receiving shell, the elastic body is received in the receiving shell of the shell and abuts against the pin; a connecting portion extends from one end of the receiving shell, a clamping piece extends outwardly from two side edges of the connecting portion. The receiving shell has a sleeve portion and a seat portion connected with a lower end of the sleeve portion, the seat portion is formed by bending a first elastic piece and a second elastic piece to form an enclosure.

Such a pin-type connector attains electrical connection depending on contact between the pin and the sleeve portion, such an electrical contact manner has a small contact area, a contact force is small and the pin always has the tendency of elasticity movement, which cause such an electrical connection to be very not stable, momentary disconnection easily occur, and the electrical connection to be not reliable.

SUMMARY

The technical problem to be solved by the present disclosure is to overcome the deficiency existing in the above prior art and provide an electrical connector which can realize stable reliable electrical connection and an electrical connector assembly which has the electrical connector.

According to one solution of the present disclosure, the present disclosure provides an electrical connector comprising a conductive seat, a movable contact pin and a spring member. The conductive seat comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section and extending; a through hole is provided at a front end of the first receiving section, an electrical connection leg extends out from the second receiving section. The movable contact pin comprises a mating portion, a tail portion and a connecting portion connected between the mating portion and the tail portion; the movable contact pin is mounted in the conductive seat in a manner that the movable contact pin can move back and forth in the conductive seat to attain a mating state or a non-mating state, the mating portion protrudes forwardly from the through hole; the two elastic contact arms elastically press against the connecting portion whether in the mating state or the non-mating state. The spring member is received in the conductive seat and used to elastically drive the movable contact pin to move forwardly in the conductive seat.

According to another solution of the present disclosure, the present disclosure provides an electrical connector assembly comprising an insulating housing and at least one the electrical connector as above, the insulating housing is formed with at least one receiving groove which penetrates the insulating housing in a front-rear direction to correspondingly receive the electrical connector; the electrical connector has at least one fixing barb protruding outwardly, so that the electrical connector is fixed in the receiving groove of the insulating housing.

In comparison with the prior art, the present disclosure at least has the following advantages: in the electrical connector of the present disclosure, the two elastic contact arms of the conductive seat clamp the connecting portion of the movable contact pin, thus have larger normal forces used to maintain contact, and whether the movable contact pin is in the mating state or in the non-mating state, the two elastic contact arms always elastically press against the connecting portion, so that the conductive seat and the movable contact pin always retain elastic contact, a current may be transmitted to the conductive seat via the movable contact pin and the conductive seat, transmission of the current is stable without the risk of momentary disconnection, reliability of electrical connection is promoted. At the same time, the two elastic contact arms allocate the current, which further may promote a magnitude of the transmitted current and lower rising of temperature, promote capability of transmitting a high current, and is beneficial to be applied in the circumstance of the high current.

DETAILED DESCRIPTION OF THE PREFERRED EMBODIMENTS

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an embodiment of the present disclosure do not to imply that every embodiment thereof must have the described feature. Furthermore, it should be noted that the description illustrates a number of features. While certain features may be combined together to illustrate potential system designs, those features may also be used in other combinations not expressly described. Thus, the described combinations are not intended to be limiting, unless otherwise noted.

In the embodiments illustrated in the figures, representations of directions such as up, down, left, right, front and rear, used for explaining the structure and movement of the various components of the present disclosure, are not absolute, but relative. These representations are appropriate when the components are in the position shown in the figures. If the description of the position of the components changes, however, these representations are to be changed accordingly.

Hereinafter, preferred embodiments of the present disclosure are further described in detail in combination with the figures of the present disclosure.

The present disclosure provides an electrical connector in form of Pogo Pin. In use, the electrical connector is mounted in electronic device and used to mate with another electrical connector (for example a conductive contact point).

For sake of convenience of description, a direction in which an end of the electrical connector is used to mate with another electrical connector is defined as "front", a direction relative to an opposite end is defined as "rear".

Referring to FIG. 1 to FIG. 6, an electrical connector 1 of the preferred embodiment includes a conductive seat 11, a movable contact pin 12 movably mounted in the conductive seat 11 and a spring member 13 received in the conductive seat 11.

Figure 7:
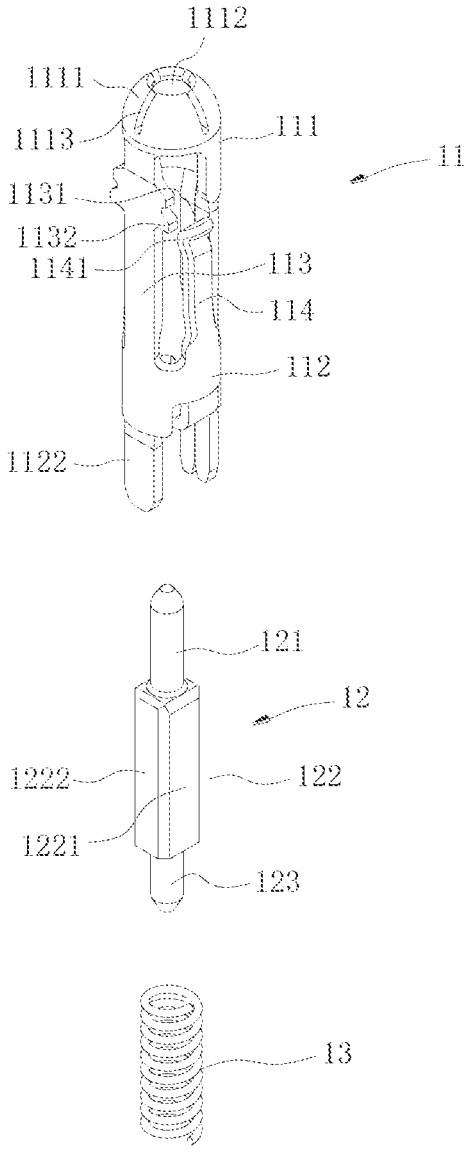
FIG. 7 and FIG. 8 are exploded perspective views of the electrical connector of FIG. 1 viewed from two different angles.
Figure 8:
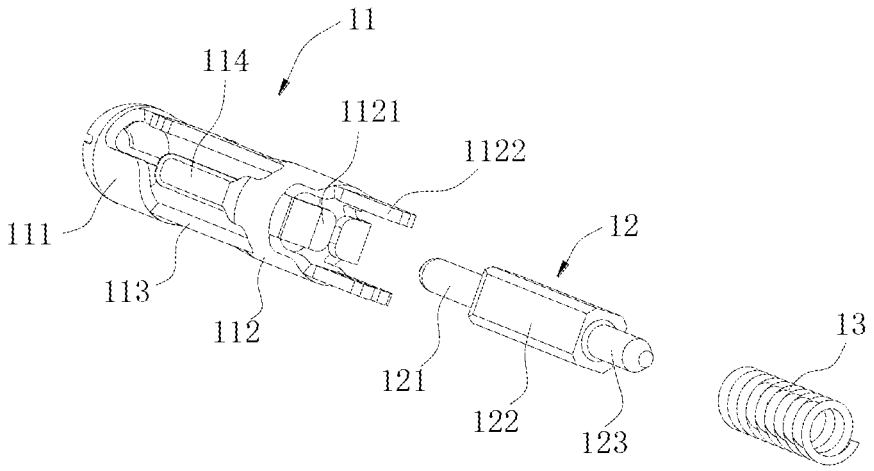

As shown in FIG. 7 and FIG. 8, the conductive seat 11 includes a first receiving section 111, a second receiving section 112 which is positioned behind the first receiving section 111, two connection arms 113 which oppose to each other and each connect the first receiving section 111 and the second receiving section 112, and two elastic contact arms 114 which oppose to each other and each inclinedly bend forwardly and inwardly from the second receiving section 112 and extend toward the receiving section 111.

Figure 1:
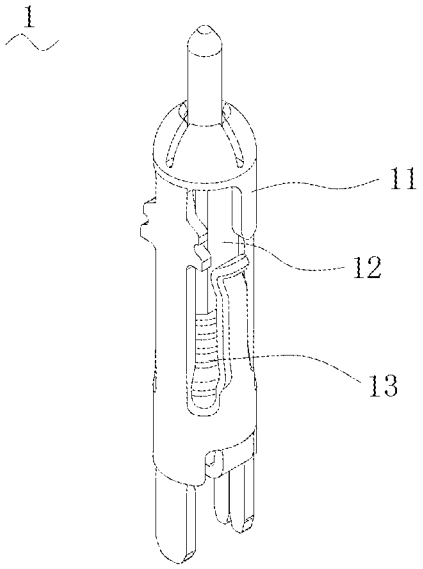
FIG. 1 and FIG. 2 are perspective views a preferred embodiment of an electrical connector of the present disclosure viewed from two different angles.
Figure 2:
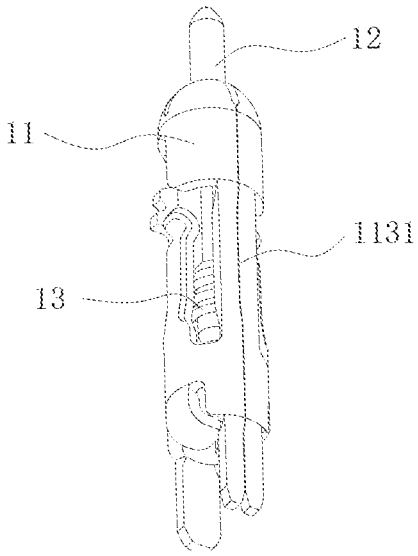
Figure 3:
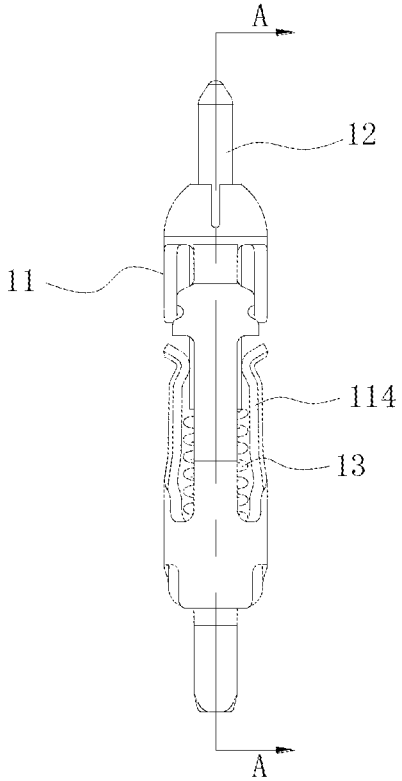
FIG. 3 is a front view of FIG. 1.
Figure 4:
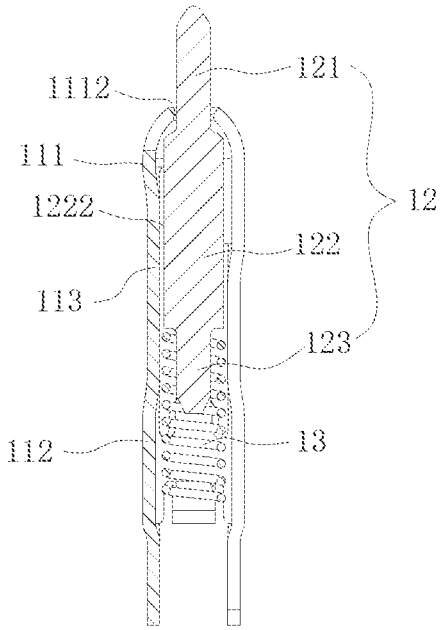
FIG. 4 is a cross sectional view taken along a line A-A of FIG. 3.
Figure 5:
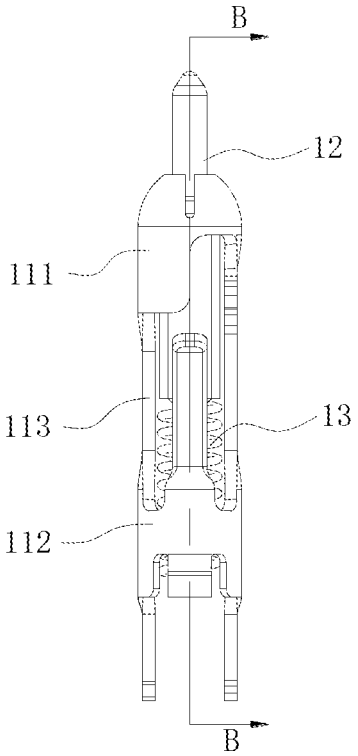
FIG. 5 is a side view of FIG. 1.
Figure 6:
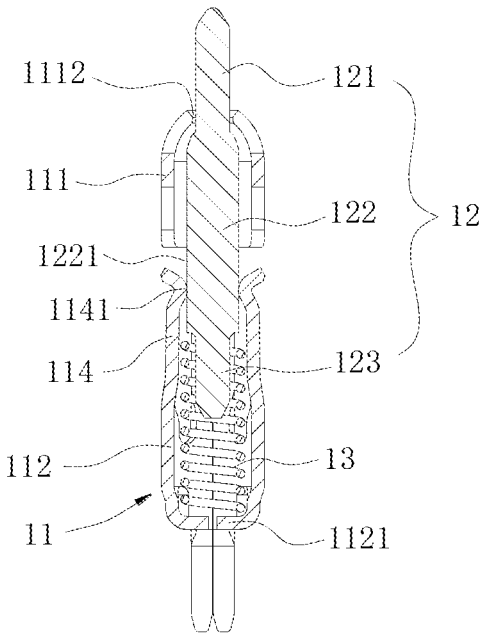
FIG. 6 is a cross sectional view taken along a line B-B of FIG. 5.

The conductive seat 11 is an integral structure, preferably is formed by integrally stamping and bending a metal plate, so that a jointing slit 1131 extending along an front-rear direction is formed on the first receiving section 111, one of the two connection arms 113 and the second receiving section 112 (the jointing slit 1131 specifically referring to FIG. 2). A plurality of fixing barbs 1132 protrude outwardly from two sides of the other of the two connection arms 113 of the electrical connector 1.

The first receiving section 111 has a hollow circular cylinder shape with a front end tapering, the front end of the first receiving section 111 preferably forms an circular arch portion 1111, a through hole 1112 is formed in a center of the circular arch portion 1111. Along a circumferential direction of the through hole 1112, the front end of the first receiving section 111 is preferably provided with a plurality of notches 1113 which each extend along a front-rear direction, which is convenient for the front end of the first receiving section 111 to perform the bending and closing processing to form the circular arch portion 1111.

The second receiving section 112 substantially has a hollow circular cylinder shape, a central axis of the second receiving section 112 coincides with a central axis of the first receiving section 111. In the preferred embodiment, a supporting portion 1121 inwardly bends perpendicularly from each of two facing sides of a rear end of the second receiving section 112, tip ends of the two supporting portions 1121 oppose to each other, are substantially in the same plane and are used to block a rear end opening of the second receiving section 112. Two electrical connection legs 1122 slightly inwardly bend from the rear end of the second receiving section 112 and further extend rearwardly, the two electrical connection legs 1122 oppose to each other and are respectively positioned at two sides of the two supporting portion 1121. In some not illustrated embodiments, the supporting portion 1121 may bend only from one side of the rear end of the second receiving section 112 and extend.

The electrical connection leg 1122 is preferably used to be fixed with a circuit board (not shown) by soldering, so that an electrical conduction path between the movable contact pin 12 and the circuit board is established. In the preferred embodiment, the electrical connection leg 1122 is in form of vertical type soldering leg, is inserted into a via of the circuit board and soldered, thereby making the conductive seat 11 erected on the circuit board. In other not illustrated embodiment, the electrical connection leg 1122 also may be a right-angle type structure, bends outwardly from the rear end of the second receiving section 112 by 90 degrees, so that after the electrical connection leg 1122 is connected with the circuit board, the conductive seat 11 may lie down and be mounted on the circuit board. It may be understood that, the electrical connection leg 1122 may be adjusted in number and structure form according to practical circumstances.

The two elastic contact arms 114 are preferably oppose to each other, which is beneficial to provide two facing forces constituting a clamping force. The elastic contact arm 114 is plate shaped, inclinedly bends forwardly and inwardly from the second receiving section 112 and extends to form a cantilever structure, and thus has elasticity. A tip end of the elastic contact arm 114 firstly further bends inwardly and then bends outwardly so as to form a contact portion 1141, the two contact portions 1141 of the two elastic contact arms 114 oppose to each other.

The two connection arms 113 oppose to each other, preferably, an inner wall of the connection arm 113 is a flat plane. An interval between the two connection arms 113 is less than an outer diameter of the first receiving section 111 and an outer diameter of the second receiving section 112, that is, the two connection arms 113 slightly offset inwardly relative to the first receiving section 111 and the second receiving section 112, so as to approach the movable contact pin 12 positioned in the conductive seat 11.

Still referring to FIG. 7 and FIG. 8, the movable contact pin 12 substantially is elongate, includes a mating portion 121 positioned at a front end thereof, a tail portion 123 positioned at a rear end thereof and a connecting portion 122 positioned between the mating portion 121 and the tail portion 123.

In the preferred embodiment, the mating portion 121 and the tail portion 123 each have circular cylinder shape. A front end of the mating portion 121 tapers to have a roundhead shape so as to facilitate mating. A length of the tail portion 123 is substantially a half of a length of the spring member 13, so as to facilitate assembling of the spring member 13.

The connecting portion 122 has a squared shape, an outer circumference of the connecting portion 122 has two first planes 1221 which are paralleled to each other and oppose to each other and two second planes 1222 which are paralleled to each other and oppose to each other. The outer circumference of the connecting portion 122 exceeds an outer circumference of the mating portion 121 and an outer circumference of the tail portion 123 in a radial direction. In the front-rear direction, the connecting portion 122 preferably has a longer length. In the preferred embodiment, the length of the connecting portion 122 substantially is a half of a total length of the movable contact pin 12.

In combination with FIG. 3 to FIG. 6, the connecting portion 122 and the tail portion 123 of the movable contact pin 12 are received in a range which is limited by the first receiving section 111 and the second receiving section 112 of the conductive seat 11, and the mating portion 121 protrude forwardly from the through hole 1112 of the first receiving section 111, so that the mating portion 121 is used to mate with another conductive contact point (not shown).

The two elastic contact arms 114 of the conductive seat 11 respectively elastically press against the connecting portion 122 of the movable contact pin 12, the contact portion 1141 of the elastic contact arm 114 slideably attaches on the first plane 1221 of the connecting portion 122. The inner walls of the two connection arms 113 respectively approach the two second planes 1222 of the connecting portion 122. Because a contact between the contact portion 1141 of the elastic contact arm 114 and the first plane 1221 of the connecting portion 122 is a linear contact perpendicular to a movable direction of the movable contact pin 12 and the connecting portion 122 is clamped by the two elastic contact arms 114, rotating of the movable contact pin 12 may be prevented in moving back and forth of the movable contact pin 12, maintain stable contact between the conductive seat 11 and the movable contact pin 12 in moving back and forth of the movable contact pin 12, and thus retain electrical connection stable. Furthermore, that the flat planes of the inner walls of the two connection arms 113 approach the two second planes 1222 of the connecting portion 122 respectively prevents the movable contact pin 12 from rotating in the conductive seat 11 so as to further retain electrical contact stable.

The spring member 13 preferably is a spring, sheathes the outer circumference of the tail portion 123, a front end of the spring member 13 abuts against a rear end of the connecting portion 122, a rear end of the spring member 13 abuts against the supporting portion 1121 of the second receiving section 112. By that the spring member 13 is limited in position by the tail portion 123 and the spring member 13 is surrounded by the two elastic contact arms 114 and the two connection arms 113 from outside, non-axial deformation of the spring member 13 can be prevented, thereby making that the spring member 13 only can elastically deform along the front-rear direction, so that the movable contact pin 12 can be stably elastically driven to move forwardly in the conductive seat 11.

The moving back and forth of the movable contact pin 12 makes the movable contact pin 12 have a mating state and a non-mating state. In the mating state, the movable contact pin 12 rearwardly moves under a mating pressure from an external conductive contact point and withdraws toward an interior of the conductive seat 11, the spring member 13 is elastically compressed and provides a forward acting force to the movable contact pin 12 to retain a reliable mating with the external conductive contact point. In the non-mating state, the external mating pressure does not exist, the spring member 13 elastically restores to drive the movable contact pin 12 to move forwardly, the mating portion 121 extend out forwardly of the circular arch portion 1111, the circular arch portion 1111 of the first receiving section 111 stops a front end of the connecting portion 122 to prevent the movable contact pin 12 from detaching forwardly out from the conductive seat 11. The connecting portion 122 preferably has a longer length along the front-rear direction (specifically in the embodiment, the connecting portion 122 has a length which is substantially a half of the length of the movable contact pin 12), so that whether in the mating state or in the non-mating state, the two elastic contact arms 114 always elastically press against the connecting portion 122 in a manner of sliding back and forth, the two elastic contact arms 114 clamp the connecting portion 122, such an elastic contact arm 114 design has a larger normal force used to retain contact, which is beneficial to retain electrical contact between the conductive seat 11 and the movable contact pin 12 stable, avoids risk of momentary disconnection, realizes stable reliable electrical connection. At the same time, two elastic contact arms 114 allocate the current, which is convenient to realize high current transmission and beneficial to lower rising of temperature (in a practical use, capability of 8A transmission has been realized).

Figure 9:
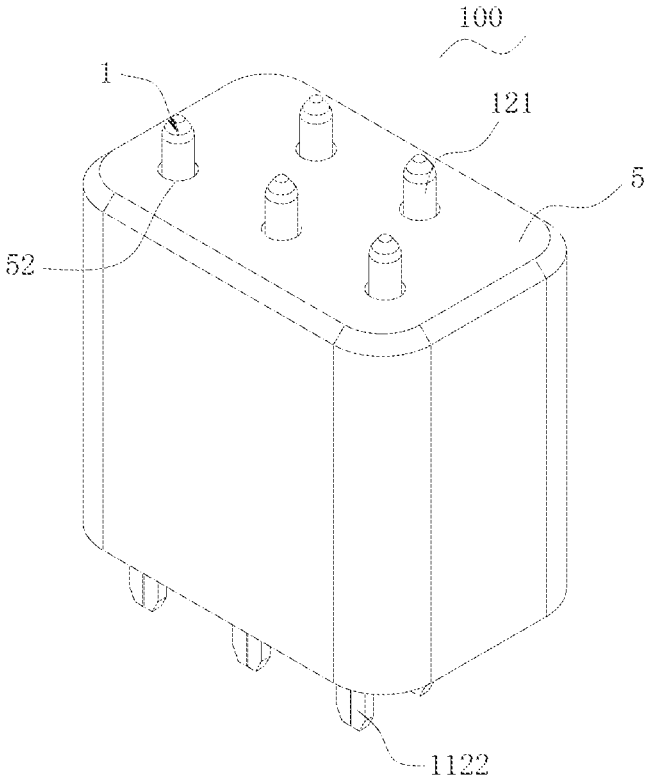
FIG. 9 and FIG. 10 are schematic views illustrating states that the electrical connector of FIG. 1 and an insulating housing assembly are in use.
Figure 10:
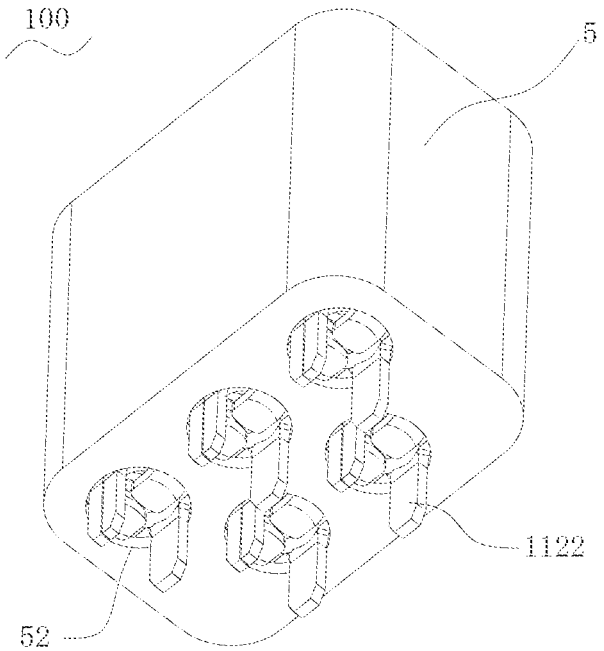
Figure 11:
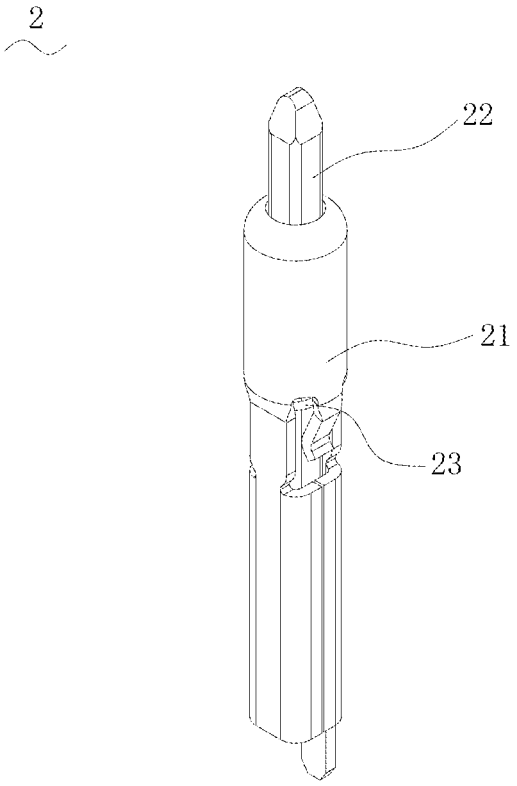
FIG. 11 and FIG. 12 are perspective views of another preferred embodiment of the electrical connector of the present disclosure viewed from two different angles.
Figure 12:
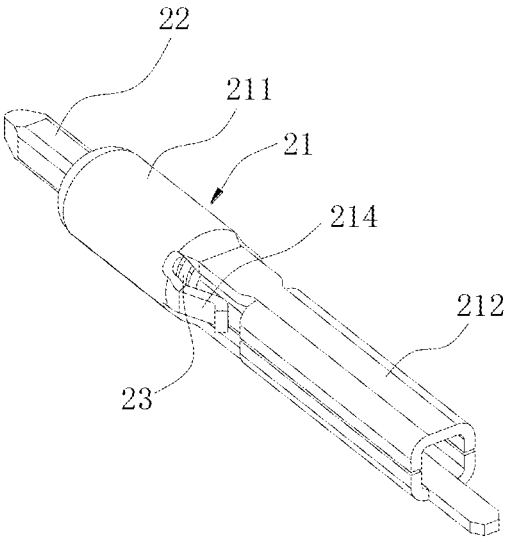
Figure 13:
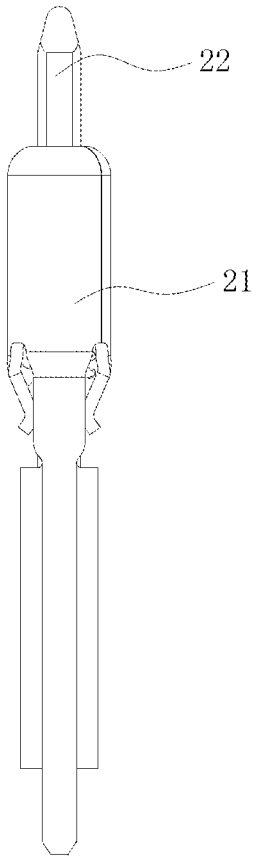
FIG. 13 is a front view of FIG. 11.
Figure 14:
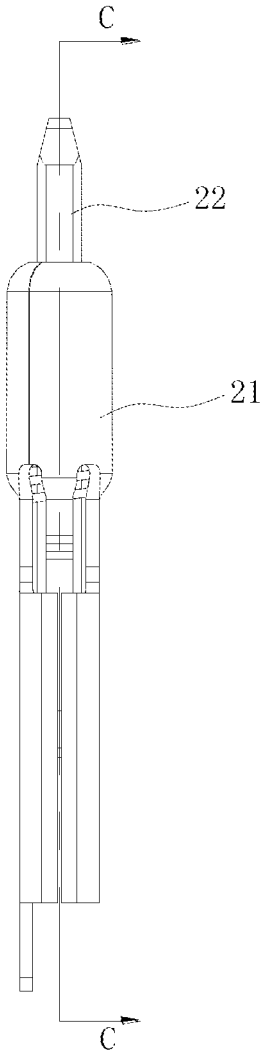
FIG. 14 is a side view of FIG. 11.
Figure 15:
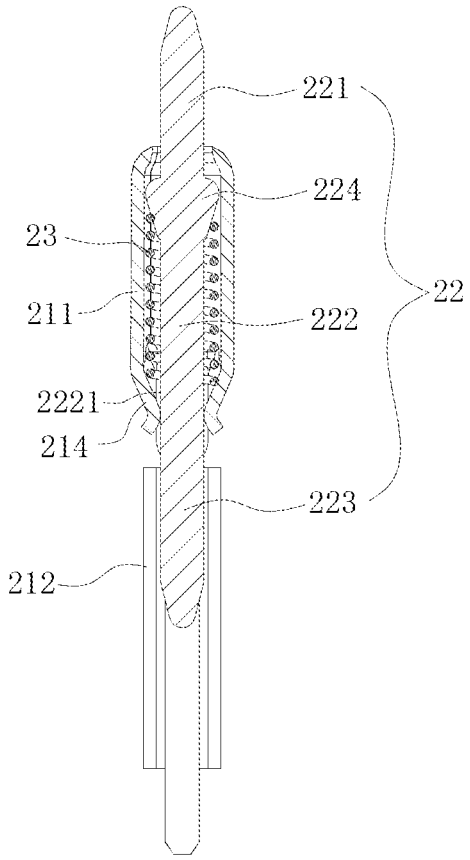
FIG. 15 is a cross sectional view taken along a line C-C of FIG. 14.
Figure 16:
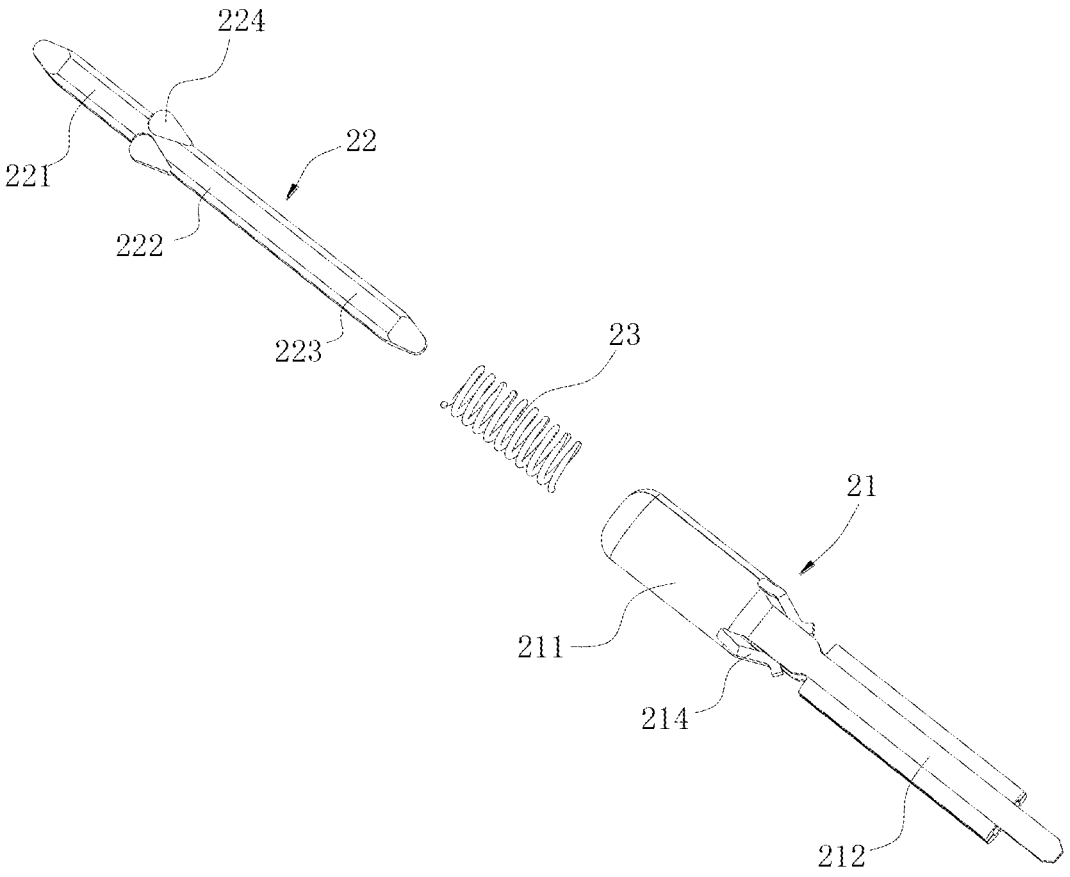
FIG. 16 is an exploded perspective view of FIG. 11.

Referring to FIG. 9 and FIG. 10, when the electrical connector 1 is in use, the electrical connector 1 is mounted in an insulating housing 5 to form an electrical connector assembly 100. The mating portion 121 of the electrical connector 1 extends forwardly out of the insulating housing 5 and is used to mate with a conductive contact point of other electronic device; the electrical connection leg 1122 extends rearwardly out of the insulating housing 5 and is used to be soldered to a circuit board. In the insulating housing 5, the electrical connector 1 may be flexibly provided in number and arrangement according to practical circumstances.

Because the electrical connector 1 itself structure may perform position limit with respect to moving back and forth of the movable contact pin 12 and may prevent the movable contact pin 12 from rotating, when the electrical connector 1 is mounted in the insulating housing 5, it only needs to make the insulating housing 5 opened with a receiving groove 52 which penetrates the insulating housing 5 in the front-rear direction and is used to cooperate with the electrical connector 1, which facilitate formation and manufacturing of the insulating housing 5; and, the fixing barb 1132 of the connection arm 113 of the electrical connector 1 may fixed in the receiving groove 52 of the insulating housing 5, so that an assembling process that the electrical connector 1 is mounted in the insulating housing 5 is simplified, and the fixing is firm and is not easily loosen, product reliability of the electrical connector assembly 100 is promoted. In some not illustrated embodiment, the fixing barb 1132 may be provided as one in number, moreover, the fixing barb 1132 also may protrude outwardly from other structure of the electrical connector 1, for example, protrude outwardly from the first receiving section 111, the second receiving section 112 or the electrical connection leg 1122.

FIG. 11 to FIG. 16 illustrates a structure of an electrical connector 2 of another preferred embodiment of the present disclosure. The electrical connector 2 of the preferred embodiment also includes a conductive seat 21, a movable contact pin 22 and a spring member 23.

A main difference from the previous embodiment lies in that, in the preferred embodiment, two elastic contact arms 214 of the conductive seat 21 inclinedly bend rearwardly and inwardly from the first receiving section 211 and extend toward the second receiving section 212. The second receiving section 212 has a square shape in which a side length thereof is slightly less than an outer diameter of the first receiving section 211. And a tail portion 223 and a connecting portion 222 of the movable contact pin 22 also both have a square shape, the tail portion 223 inserts into the second receiving section 212 with clearance fit, each outer circumferential surface of the tail portion 223 correspondingly approaches each inner wall of the second receiving section 212, which may prevent the movable contact pin 22 from oscillating left and right and rotating in the conductive seat 21. A protruding portion 224 protruding outwardly is further provided behind the mating portion 221 in the movable contact pin 22. The spring member 23 is received in the first receiving section 211, sheathes an outer circumference of the connecting portion 222, a front end of the spring member 23 abuts against the protruding portion 224 from below, a rear end of the spring member 23 abuts against a rear end of the first receiving section 211, the rear end of the first receiving section 211 tapers.

Similar to the previous embodiment, whether in the mating state or in non-mating state, the two elastic contact arms 214 always respectively elasticity press against two first planes 2221 of the connecting portion 222, which whether in the mating state or in the non-mating state, retains stable electrical contact, prevents momentary disconnection.

In the embodiment, by that the tail portion 223 and the second receiving section 212 cooperate with each other with the square shape structures closing to each other, rotating of the movable contact pin 22 in the conductive seat 21 may be prevented, which further promotes stability of electrical contact between the movable contact pin 22 and the conductive seat 21.

As can be seen from the above description, the electrical connector 1, 2 of the above preferred embodiment of the present disclosure, the two elastic contact arms 114, 214 of the conductive seat 11, 21 clamp the connecting portion 122, 222 of the movable contact pin 12, 22, thus have larger normal forces used to maintain contact, and whether the movable contact pin 12, 22 is in the mating state or in the non-mating state, the two elastic contact arms 114, 214 always elastically press against the connecting portion 122, 222 in a manner of sliding back and forth, so that the conductive seat 11, 21 and the movable contact pin 12, 22 always retain elastic contact, a current may be transmitted to the conductive seat 11, 21 via the movable contact pin 12, 22 and then transmitted to the circuit board via the conductive seat 11, 21, transmission of the current is stable without the risk of momentary disconnection, reliability of electrical connection is promoted. At the same time, the two elastic contact arms 114, 214 allocate the current, which further may promote a magnitude of the transmitted current and lower rising of temperature, promote capability of transmitting a high current, and is beneficial to be applied in the circumstance of the high current.

Further, by that the elastic contact arms 114 cooperates with the connection arms 113 to form a fence-type structure with a square shape, the connecting portion 122 is limited, or further by that the square shape structure of the second receiving section 212 cooperates with the square shape structure of the tail portion 223 to realize limitation, rotating of the movable contact pin 12, 22 in the moving back and forth of the movable contact pin 12, 22 may be prevented, stability of electrical contact may be further retained.

The above described contents are only the preferred embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector, comprising:

a conductive seat, which comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section;

a through hole being provided at a front end of the first receiving section, an electrical connection leg extending out from the second receiving section;

a movable contact pin, which comprises a mating portion, a tail portion and a connecting portion connected between the mating portion and the tail portion; the movable contact pin being mounted in the conductive seat in a manner that the movable contact pin can move back and forth in the conductive seat to attain a mating state or a non-mating state, the mating portion protruding forwardly from the through hole; the two elastic contact arms elastically pressing against the connecting portion whether in the mating state or the non-mating state; and a spring member, which is received in the conductive seat and surrounds the tail portion of the movable contact pin, the spring member configured to contact an end of the connecting portion to elastically drive the movable contact pin to move forwardly in the conductive seat.

2. The electrical connector according to claim 1, wherein an outer circumference of the connecting portion of the movable contact pin is provided with two opposite first planes;

the two elastic contact arms are arranged oppositely and respectively press against the two first planes.

3. An electrical connector, comprising:

a conductive seat, which comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section;

a through hole being provided at a front end of the first receiving section, an electrical connection leg extending out from the second receiving section;

a movable contact pin, which comprises a mating portion, a tail portion and a connecting portion connected between the mating portion and the tail portion; the movable contact pin being mounted in the conductive seat in a manner that the movable contact pin can move back and forth in the conductive seat to attain a mating state or a non-mating state, the mating portion protruding forwardly from the through hole; the two elastic contact arms elastically pressing against the connecting portion whether in the mating state or the non-mating state; and a spring member, which is received in the conductive seat and used to elastically drive the movable contact pin to move forwardly in the conductive seat, wherein an outer circumference of the connecting portion of the movable contact pin is provided with two opposite first planes, wherein the two elastic contact arms are arranged oppositely and respectively press against the two first planes, wherein the outer circumference of the connecting portion is further provided with at least one second plane, and wherein an inner wall of the connection arm is a flat surface and approaches the second plane so as to prevent the movable contact pin from rotating in the conductive seat.

4. The electrical connector according to claim 1, wherein the two elastic contact arms inclinedly bend forwardly and inwardly from the second receiving section toward the first receiving section and surround the spring member from outside.

5. An electrical connector, comprising:

a conductive seat, which comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section;

a through hole being provided at a front end of the first receiving section, an electrical connection leg extending out from the second receiving section;

a movable contact pin, which comprises a mating portion, a tail portion and a connecting portion connected between the mating portion and the tail portion; the movable contact pin being mounted in the conductive seat in a manner that the movable contact pin can move back and forth in the conductive seat to attain a mating state or a non-mating state, the mating portion protruding forwardly from the through hole; the two elastic contact arms elastically pressing against the connecting portion whether in the mating state or the non-mating state; and a spring member, which is received in the conductive seat and used to elastically drive the movable contact pin to move forwardly in the conductive seat, wherein the spring member sheathes an outer circumference of the tail portion, a front end of the spring member abuts against a rear end of the connecting portion, and wherein a supporting portion bends inwardly from a rear end of the second receiving section to abut against a rear end of the spring member.

6. The electrical connector according to claim 1, wherein the conductive seat is formed by integrally stamping and bending a metal plate, the at least one connection arm is a pair of opposing connection arms.

7. An electrical connector, comprising:

a conductive seat, which comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section;

a through hole being provided at a front end of the first receiving section, an electrical connection leg extending out from the second receiving section;

a movable contact pin, which comprises a mating portion, a tail portion and a connecting portion connected between the mating portion and the tail portion; the movable contact pin being mounted in the conductive seat in a manner that the movable contact pin can move back and forth in the conductive seat to attain a mating state or a non-mating state, the mating portion protruding forwardly from the through hole; the two elastic contact arms elastically pressing against the connecting portion whether in the mating state or the non-mating state; and a spring member, which is received in the conductive seat and used to elastically drive the movable contact pin to move forwardly in the conductive seat, wherein the tail portion of the movable contact pin and the second receiving section of the conductive seat both have a square shape, and wherein the tail portion inserts into the second receiving section in a manner that the tail portion can move back and forth in the second receiving section, the tail portion and an inner wall of the second receiving section approach each other so as to prevent the movable contact pin from rotating in the conductive seat.

8. The electrical connector according to claim 7, wherein the movable contact pin is further provided with a protruding portion which is positioned behind the mating portion and protrudes outwardly;

two ends of the spring member respectively abut against the protruding portion and a rear end of the first receiving section;

the two elastic contact arms inclinedly bend rearwardly and inwardly from the first receiving section and extend toward the second receiving section.

9. The electrical connector according to claim 1, wherein a front end of the first receiving section is provided with a plurality of notches extending along a front-rear direction, the front end of the first receiving section forms a circular arch portion, the through hole is formed in a center of the circular arch portion.

10. An electrical connector assembly, comprising:

an electrical connector, the electrical connector comprising a conductive seat, a movable contact pin, and a spring member, the conductive seat comprises a first receiving section, a second receiving section positioned behind the first receiving section, at least one connection arm connected between the first receiving section and the second receiving section, and two elastic contact arms extending from one of the first receiving section and the second receiving section toward the other of the first receiving section and the second receiving section, the first receiving section having a through hole provided at a front end thereof, the second receiving section having an electrical connection leg extending out therefrom, the movable contact pin comprises a mating portion, a tail portion and a connecting portion connected between the mating portion and the tail portion, the movable contact pin being mounted in the conductive seat in a manner that the movable contact pin can move back and forth in the conductive seat to attain a mating state or a non-mating state, the mating portion protruding forwardly from the through hole, the two elastic contact arms elastically pressing against the connecting portion whether in the mating state or the non-mating state, and a spring member, which is received in the conductive seat and used to elastically drive the movable contact pin to move forwardly in the conductive seat, an insulating house, the insulating housing being formed with at least one receiving groove which penetrates the insulating housing in a front-rear direction to correspondingly receive the electrical connector;

the electrical connector having at least one fixing barb protruding outwardly, so that the electrical connector being fixed in the receiving groove of the insulating housing.

* * * * *